US008398439B1

(12) United States Patent
Wang

(10) Patent No.: US 8,398,439 B1
(45) Date of Patent: Mar. 19, 2013

(54) ELECTRICAL CONNECTOR

(75) Inventor: Hung-Chi Wang, New Taipei (TW)

(73) Assignee: Proconn Technology Co., Ltd., New Taipei (TW)

( * ) Notice: Subject to any disclaimer, the term of this patent is extended or adjusted under 35 U.S.C. 154(b) by 0 days.

(21) Appl. No.: 13/326,311

(22) Filed: Dec. 14, 2011

(51) Int. Cl.
*H01R 24/00* (2006.01)

(52) U.S. Cl. ..... 439/660; 439/607.54

(58) Field of Classification Search ..... 439/660, 439/607.35, 607.36, 607.4, 607.54
See application file for complete search history.

(56) References Cited

U.S. PATENT DOCUMENTS

2009/0117784 A1* 5/2009 Wu ..... 439/660
2011/0159746 A1* 6/2011 He ..... 439/660
2011/0195601 A1* 8/2011 Chen et al. ..... 439/607.01
2012/0225583 A1* 9/2012 Kamarauskas et al. .. 439/607.01

* cited by examiner

*Primary Examiner* — James Harvey
(74) *Attorney, Agent, or Firm* — Lin & Associates IP, Inc.

(57) ABSTRACT

An electrical connector includes an insulating body having a base portion and a tongue portion extending forward from a front side of the base portion. A top surface of the tongue portion defines a plurality of terminal fillisters each extending along a front-to-rear direction to penetrate through the tongue portion and the base portion. Two inner sides of a front end of each terminal fillister protrude face-to-face to form two holding portions with an interval therebetween gradually narrowing from rear to front. A plurality of terminals each has a contact arm disposed in the terminal fillister. A shielding shell encloses the insulating body to define an inserting space between the shielding shell and the tongue portion. The contact arm has a front end thereof held between the holding portions to avoid curling under the action of inserting a mating connector into the inserting space.

2 Claims, 3 Drawing Sheets

ELECTRICAL CONNECTOR

BACKGROUND OF THE INVENTION

1. Field of the Invention

The present invention relates to an electrical connector, and more particularly to an electrical connector adapted for connecting with a mating connector.

2. The Related Art

A conventional electrical connector includes an insulating body, a plurality of terminals assembled in the insulating body, and a shielding shell enclosing the insulating body. The insulating body has a base portion, and a tongue portion protruding forward from a substantial middle of a front side of the base portion. The tongue portion stretches in the shielding shell and is apart from periphery inner sides of the shielding shell to define an inserting space between the shielding shell and the tongue portion. A plurality of terminal fillisters is opened in a top surface of the tongue portion, and each extends along a front-to-rear direction to penetrate through the base portion and the tongue portion. The terminals are disposed in the terminal fillisters respectively. However, in the process of inserting a mating connector into the inserting space of the electrical connector, front ends of the terminals are apt to be curled to cause a poor connection with the mating connector, and further shorten the using life of the electrical connector.

SUMMARY OF THE INVENTION

It is an object of the present invention to provide an electrical connector adapted for connecting with a mating connector. The electrical connector includes an insulating body having a base portion and a tongue portion of a horizontal board shape extending forward from a front side of the base portion. A top surface of the tongue portion defines a plurality of terminal fillisters each extending along a front-to-rear direction to penetrate through the tongue portion and the base portion. Two inner sides of a front end of each terminal fillister protrude face-to-face to form a pair of holding portions with an interval therebetween gradually narrowing from rear to front. A plurality of terminals each has a strip-shaped contact arm disposed in the terminal fillister of the insulating body, and a soldering tail extending from a rear end of the contact arm to stretch behind the base portion. A shielding shell encloses the insulating body with the tongue portion located in the shielding shell and being apart from periphery inner sides of the shielding shell to define an inserting space between the shielding shell and the tongue portion. The contact arm of the terminal has a front end thereof held between the holding portions of the terminal fillister to avoid curling under the action of inserting the mating connector into the inserting space of the electrical connector.

As described above, the two inner sides of the front end of each terminal fillister define the pair of holding portions with the interval therebetween gradually narrowing from rear to front for holding the front end of the contact arm therebetween. So, it effectively avoids the front ends of the contact arms curling under the action of inserting the mating connector into the inserting space of the electrical connector, so as to ensure a steady connection between the electrical connector and the mating connector and further extend the using life of the electrical connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
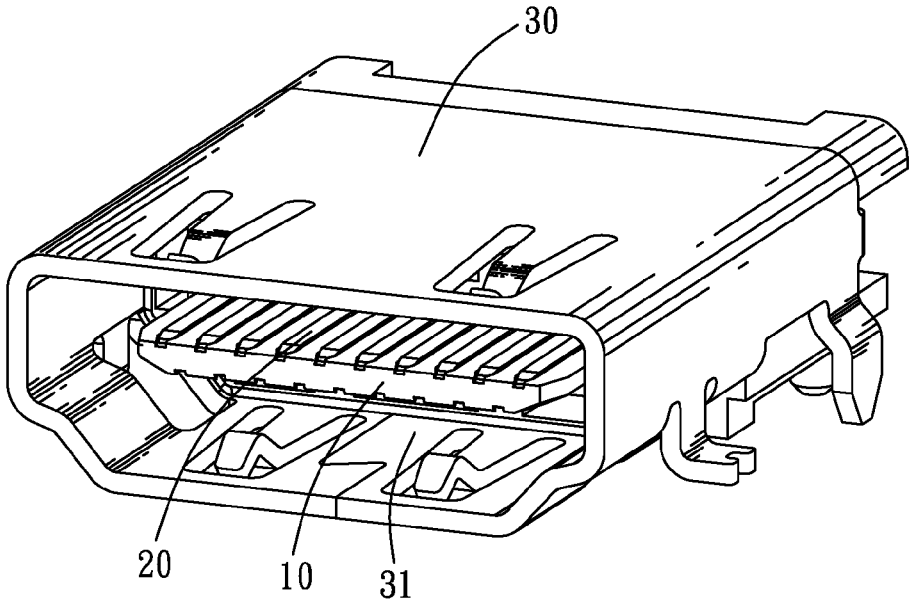
FIG. 1 is a perspective view of an electrical connector in accordance with an embodiment of the present invention.

Referring to FIG. 1, an electrical connector according to an embodiment of the present invention includes an insulating body 10, a plurality of terminals 20 assembled in the insulating body 10, and a shielding shell 30 enclosing the insulating body 10 together with the terminals 20. The electrical connector is adapted for electrically connecting with a mating connector (not shown).

Figure 2:
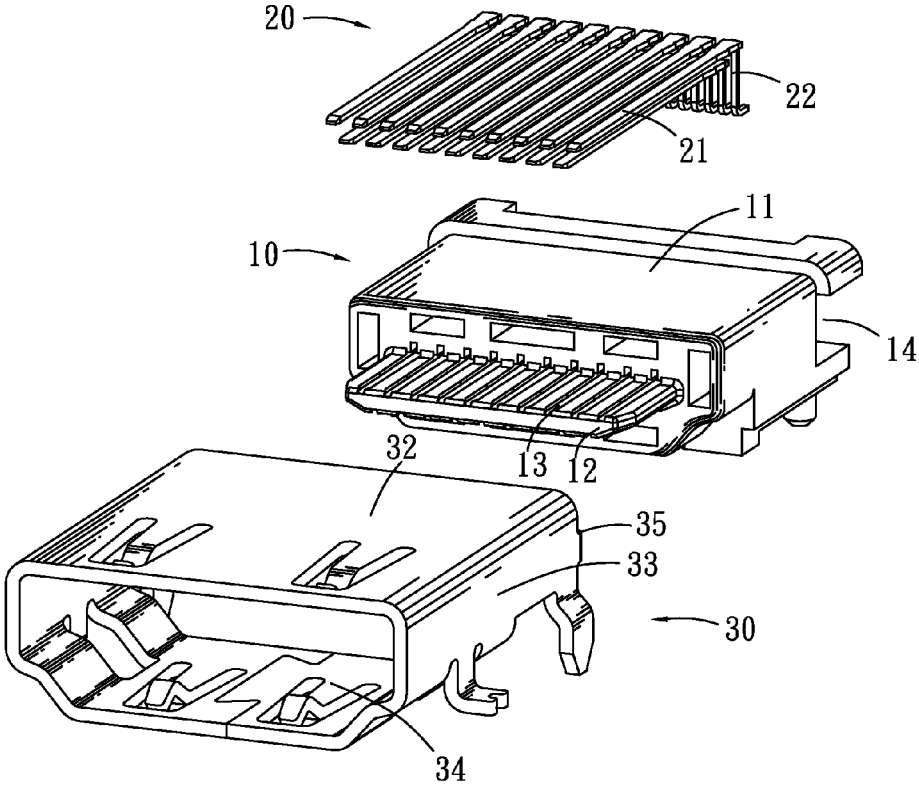
FIG. 2 is an exploded view of the electrical connector of FIG. 1.
Figure 3:
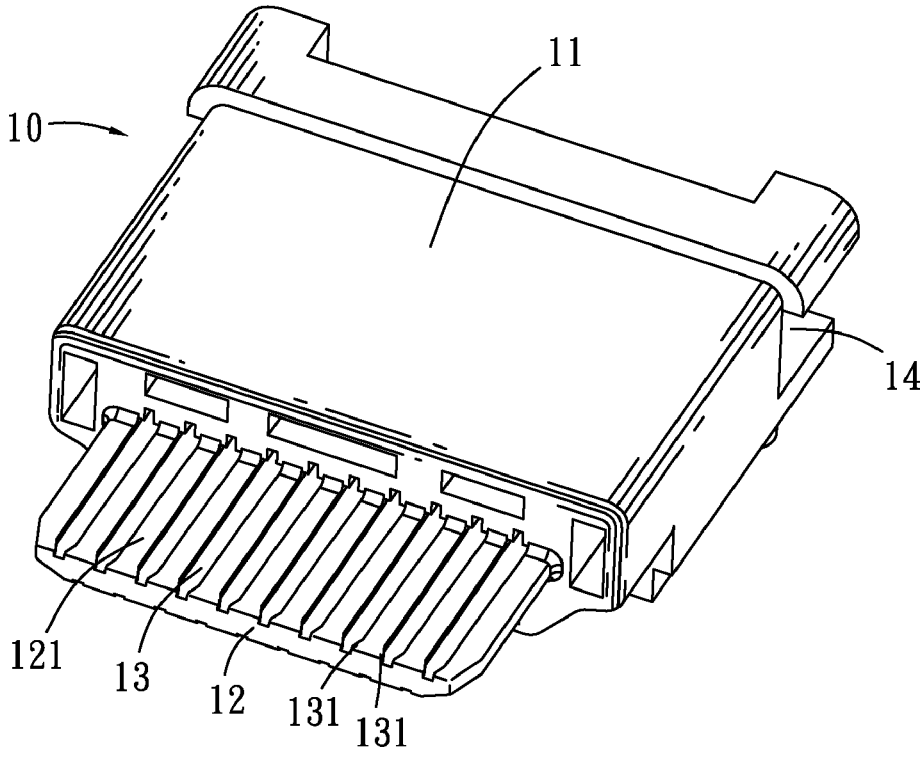
FIG. 3 is a perspective view of an insulating body of the electrical connector of FIG. 2.

Referring to FIG. 2 and FIG. 3, the insulating body 10 has a base portion 11 and a tongue portion 12 of a horizontal board shape extending forward from a front side of the base portion 11. A top surface 121 of the tongue portion 12 defines a plurality of terminal fillisters 13 each extending along a front-to-rear direction to penetrate through the tongue portion 12 and the base portion 11. Two inner sides of a front end of each terminal fillister 13 protrude face-to-face to form a pair of holding portions 131 with an interval therebetween gradually narrowing from rear to front. A rear of the base portion 11 of the insulating body 10 defines two fastening cavities 14 at two sides thereof.

Referring to FIG. 1 and FIG. 2, each of the terminals 20 has a strip-shaped contact arm 21 disposed in the corresponding terminal fillister 13 of the insulating body 10, and a soldering tail 22 extending from a rear end of the contact arm 21 to stretch behind the base portion 11.

Referring to FIGS. 1-3, the shielding shell 30 is curved from a metal plate and has a top plate 32, two side plates 33 extending downward from two opposite side edges of the top plate 32, and two bottom plates 34 extending towards each other from bottom edges of the side plates 33 to be wedged with each other. The shielding shell 30 encloses the insulating body 10 with the tongue portion 12 located in the shielding shell 30 and being apart from periphery inner sides of the shielding shell 30 to define an inserting space 31 between the shielding shell 30 and the tongue portion 12 for receiving the mating connector therein. The contact arms 21 of the terminals 20 are exposed in the inserting space 31 to electrically connect with the mating connector. The contact arm 21 of the terminal 20 has a front end thereof held between the holding portions 131 of the terminal fillister 13 to avoid curling under the action of inserting the mating connector into the inserting space 31 of the electrical connector. Rear edges of the side plates 33 of the shielding shell 30 bend inward to form a pair of fastening portions 35 buckled in the corresponding fastening cavities 14 of the insulating body 10.

As described above, the two inner sides of the front end of each terminal fillister 13 define the pair of holding portions 131 with the interval therebetween gradually narrowing from rear to front for holding the front end of the contact arm 21 therebetween. So, it effectively avoids the front ends of the contact arms 21 curling under the action of inserting the mating connector into the inserting space 31 of the electrical connector, so as to ensure a steady connection between the electrical connector and the mating connector and further extend the using life of the electrical connector.

What is claimed is:

1. An electrical connector adapted for connecting with a mating connector, comprising:

an insulating body having a base portion and a tongue portion of a horizontal board shape extending forward from a front side of the base portion, a top surface of the tongue portion defining a plurality of terminal fillisters each extending along a front-to-rear direction to penetrate through the tongue portion and the base portion, two inner sides of a front end of each terminal fillister protruding face-to-face to form a pair of holding portions with an interval therebetween gradually narrowing from rear to front;

a plurality of terminals each having a strip-shaped contact arm disposed in the terminal fillister of the insulating body, and a soldering tail extending from a rear end of the contact arm to stretch behind the base portion; and a shielding shell enclosing the insulating body with the tongue portion located in the shielding shell and being apart from periphery inner sides of the shielding shell to define an inserting space between the shielding shell and the tongue portion, wherein the contact arm of the terminal has a front end thereof held between the holding portions of the terminal fillister to avoid curling under the action of inserting the mating connector into the inserting space of the electrical connector.

2. The electrical connector as claimed in claim 1, wherein a rear of the base portion of the insulating body defines two fastening cavities at two sides thereof, the shielding shell is curved from a metal plate and has a top plate, two side plates extending downward from two opposite side edges of the top plate, and two bottom plates extending towards each other from bottom edges of the side plates to be wedged with each other, rear edges of the side plates bend inward to form a pair of fastening portions buckled in the corresponding fastening cavities of the insulating body.

* * * * *